US005544889A

United States Patent [19]

Moon

[11] Patent Number: 5,544,889

[45] Date of Patent: Aug. 13, 1996

[54] GOLF BALL

[75] Inventor: Jae-Chang Moon, Kwangju, Rep. of Korea

[73] Assignee: Kumho & Co., Inc., Seoul, Rep. of Korea

[21] Appl. No.: 368,169

[22] Filed: Jan. 3, 1995

[30] Foreign Application Priority Data

Nov. 28, 1994 [KR] Rep. of Korea ..... 31540/1994

[51] Int. Cl.[6] ..... A63B 37/14

[52] U.S. Cl. ..... 473/383

[58] Field of Search ..... 273/232; 40/327

[56] References Cited

U.S. PATENT DOCUMENTS

| | | | |
|---|---|---|---|
| 4,141,559 | 2/1979 | Melvin et al. | 273/232 X |
| 4,142,727 | 3/1979 | Shaw et al. | 273/232 |
| 4,560,168 | 12/1985 | Aoyama | 273/232 |
| 4,762,326 | 8/1988 | Gobush | 273/232 |
| 4,765,626 | 8/1988 | Gobush | 273/232 |
| 4,772,026 | 9/1988 | Gobush | 273/232 |
| 4,932,664 | 6/1990 | Pocklington et al. | 273/232 |
| 4,948,143 | 8/1990 | Aoyama | 273/232 |
| 4,960,281 | 10/1990 | Aoyama | 273/232 |
| 5,033,750 | 7/1991 | Yamagishi et al. | 273/232 |
| 5,253,872 | 10/1993 | Lemons et al. | 273/232 |

*Primary Examiner*—George J. Marlo
*Attorney, Agent, or Firm*—Lowe, Price, LeBlanc & Becker

[57] ABSTRACT

A golf ball is disclosed with dimples uniformly distributed over its surface so that eight identical spherical triangles do not intersect any of the dimples. The surface of the golf ball is divided into 4 identical equilateral spherical triangles which are so oriented as to have the equator of the ball form a shared leg of two of the triangles and to bisect the remaining two triangles. The surface of the ball is further divided by constructing a second equator or great circle which is perpendicular to the first equator and bisects the two triangles not already bisected. The pole of the golf ball lies neither at the center nor at the intersection of the apices of any of the constraining figures.

21 Claims, 10 Drawing Sheets

GOLF BALL

BACKGROUND OF THE INVENTION

This invention relates to golf balls and more particularly to golf balls having indentations or dimples formed on the surface which are evenly and uniformly distributed so that the ball has two perpendicular axes of symmetry. The geometric shapes forming the dimple constraining pattern for these golf balls do not have apices or centers at the poles.

In the manufacture of golf balls, regardless of whether the golf ball is of the solid, two-piece or three piece variety, two essentially hemispherical mold cavity halves are brought together in a molding press and the outer surface of the ball is formed. Where these mold halves meet is known as the "seam line" of the ball. Manufacturing constraints require that the seam line be free of any dimples. This dimple free great circle which is created on the surface of the ball presents two major problems to the golf ball manufacturer.

The first problem is of a purely aesthetic nature. The lack of dimples at the seam line appears to be a manufacturing flaw or defect in the eyes of the consumer. The increased fret area or space between the dimples in this area can give the illusion that the ball is not spherical. This illusion is further enhanced by the fact that the dimples of the constraining pattern of all golf balls either meet at the poles in apices or has the pole as the center of one of its constraining figures. U.S. Pat. No. 4,932,664 discloses a golf ball having a dimple placement on the surface of the sphere in order to minimize the appearance and effect of an unbroken seam line. Since the constraining pattern has a polar dimple which is the center of a pentagon and the pattern is radially repeated five times about this polar dimple, the pattern is not completely effective.

The second and more severe problem is that by having only one dimple free great circle, the aerodynamic performance of the ball is affected. Smooth, undimpled areas on a golf ball have increased aerodynamic drag. If a ball is hit in such a manner that this dimple free great circle is exposed during the majority of the flight of the ball, the ball will fly significantly differently than if this dimple free area is exposed only occasionally during the flight of the ball.

This difference in aerodynamic performance has led the United States Golf Association (USGA) to establish a rule governing the flight performance of a golf ball. This rule, known as the "symmetry rule", establishes very tight performance specifications on the differences in performance of the golf ball when struck on the equator (seam line) such that rotation of the ball is about an axis through the equator (referred to as pole over pole rotation) versus when the ball is struck on the equator such that rotation of the ball is about an axis through the poles of the ball (referred to as poles horizontal rotation). If the ball fails to meet the criteria of the symmetry rule it is taken off the list of balls approved for tournament play. This naturally has a disastrous effect on the sales of the product and requires that the manufacturer make changes in the product so that it will pass the "rule". These changes involve expensive tooling changes and even though these changes are made, the ball will not be retested for a minimum of six months.

The possibility of being removed from the approved list of the USGA has caused the manufacturers to seek dimple patterns which will meet the aerodynamic performance criteria of the "symmetry rule". A number of patented dimple patterns involving multiple parting lines or dimple free great circles has resulted. U.S. Pat. Nos. 4,560,168; 4,762,326; 4,765,626; 4,772,026; and 4,948,143 all describe patterns with multiple parting lines. These patents teach 6, 7, 3, 6, and 4 parting lines or dimple free great circles respectively.

While each of the patents referenced in the previous paragraph offer a solution to the passage of the symmetry rule it has long been known and is taught in U.S. Pat. No. 4,141,559 that it is most advantageous to have no circumferential pathways which do not intersect dimples if the distance performance is to be maximized.

SUMMARY OF THE INVENTION

The present invention is directed to a golf ball satisfying an aerodynamic symmetry rule and providing improved distance performance.

A golf ball having features of the present invention comprises a spherical surface with a plurality of dimples formed, and two great circles or equators which do not intersect any dimples.

A golf ball is made in accordance with the present invention by dividing the surface of the golf ball into four identical equilateral spherical triangles which correspond to a regular spherical tetrahedron. The spherical tetrahedron is then rotated on the surface of the sphere such that one of the bases which is shared by two of the triangles is coincident with a section of the parting line. By necessity, another of the bases shared by two of the triangles will be perpendicular to the parting line. The four equilateral spherical triangles are then bisected to form eight identical spherical triangles. This bisection is accomplished by first extending the base of the triangle which is coincident with the parting line so that it forms a great circle. By so doing, two of the triangles of the tetrahedron are bisected. By extending the base of the triangle which is perpendicular to the parting line so that it forms a great circle, the other two triangles of the tetrahedron are bisected and the two great circles which are the bisectors will be perpendicular to each other. Thus the eight identical spherical triangles of the present invention are formed.

Dimples are evenly and uniformly distributed over the surface of the golf ball by arranging the dimples inside the eight identical spherical triangles in such a manner that none of the dimples intersect the legs of the triangles,

DETAILED DESCRIPTION OF THE INVENTION

In order to better understand the current invention, it is helpful to review the accompanying drawings, as follows.

Figure 1:
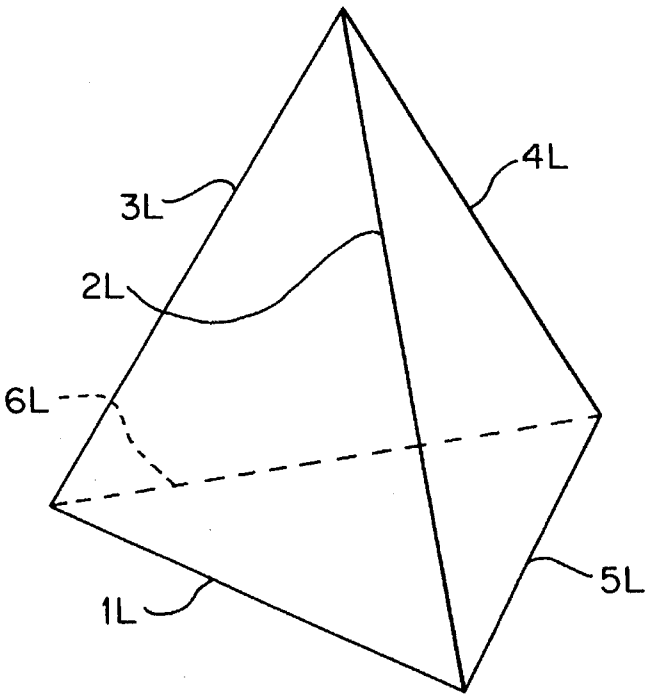
FIG. 1 is a drawing of a tetrahedron constructed of 4 equilateral triangles.

FIG. 1 is an illustration of a tetrahedron as is well known in the sciences, being constructed of four equilateral triangles; with its base triangle on a horizontal plane, and the other three triangles so inclined that their apexes meet at a single point and their sides are coincident. FIG. 1 is drawn isometrically for a three dimensional view of the tetrahedron. The legs of the triangles are all the same length and are labeled 1L through 6L. Leg 6L is shown as a dashed line since it is hidden from view.

Figure 2:
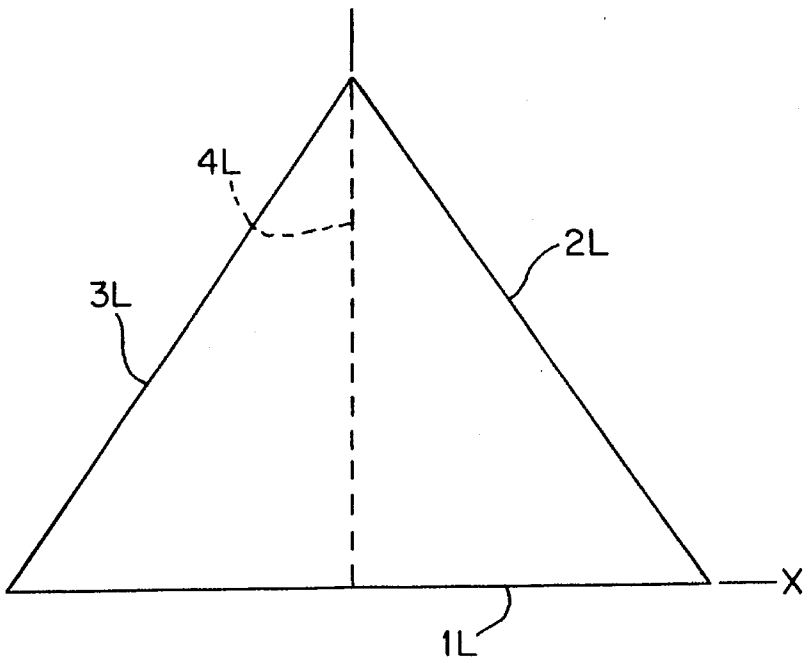
FIG. 2 is a frontal view of the tetrahedron of FIG. 1 along the Y axis.

FIG. 2 is a frontal view of the tetrahedron of FIG. 1 along the Y axis. The legs are identified the same as in FIG. 1, but the legs 5L and 6L cannot be seen since they lie in the X-Y plane, and leg 4L is now shown as a dashed line since it is now hidden from view.

Figure 3:
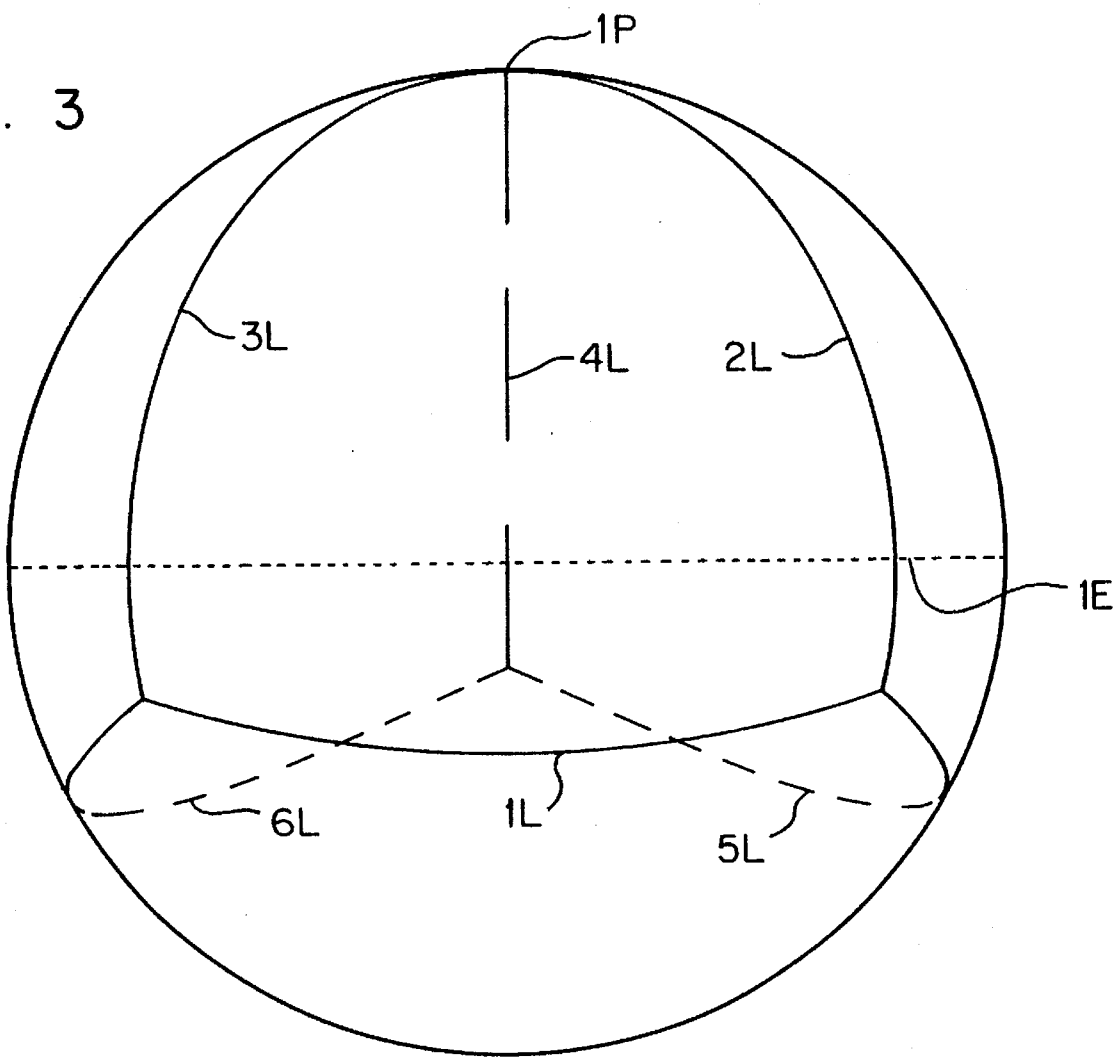
FIG. 3 is a drawing of a sphere having drawn thereon an outline of a spherical tetrahedron oriented in the same angular relationship as the tetrahedron shown in FIG. 2.

FIG. 3 is an illustration of a spherical tetrahedron oriented in the same angular relationship as the tetrahedron of solid geometry shown in FIG. 2. The dotted line identified as 1E is the equator of the sphere onto which the tetrahedron has been superimposed. The four equilateral spherical triangles of the spherical tetrahedron have their legs identified. Legs 1L, 2L, and 3L identify one triangle. Legs 1L, 5L, and 6L identify a second triangle. Legs 5L, 2L, and 4L identify a third triangle. Legs 3L, 4L, and 6L identify the fourth triangle. It should be noted that each leg of each triangle is shared or is common with an adjacent triangle. It can readily be seen that three of the triangles meet at point 1P which is the pole of the sphere. In this view the great circle which is the equator (1E) appears as a straight line. Legs 5L and 6L are shown as solid lines where they are visible in this view and are shown as dashed lines where they are hidden by the surface of the sphere.

Figure 4:
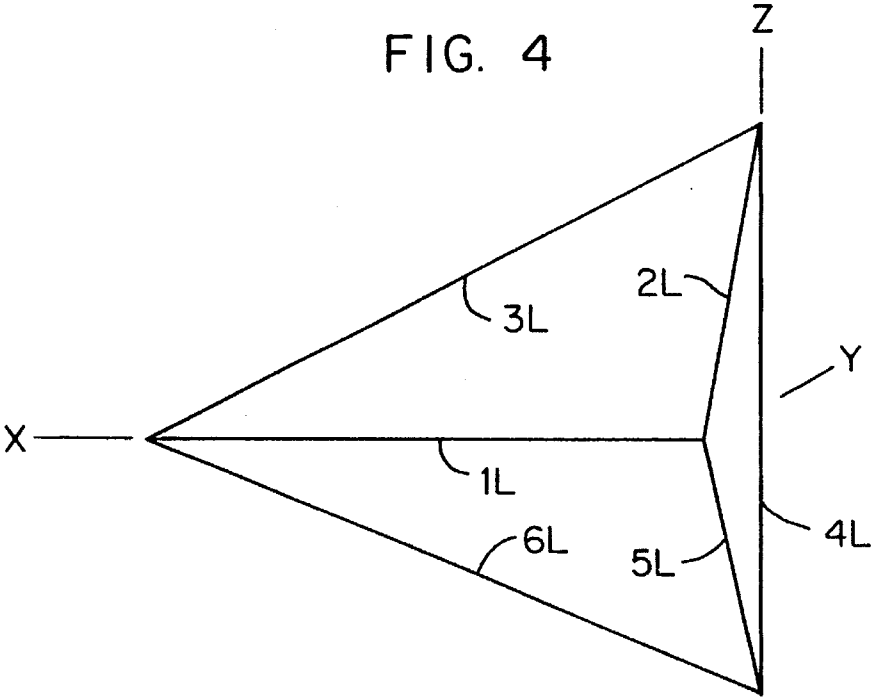
FIG. 4 is a drawing of the tetrahedron of FIG. 1 where the tetrahedron has been rotated so that two legs respectively lie along the X axis and Z axis.

FIG. 4 is an isometric view of the tetrahedron of FIG. 1 where the tetrahedron has been rotated so that one of its legs lies along the X axis and another leg lies along the Z axis.

Figure 5:
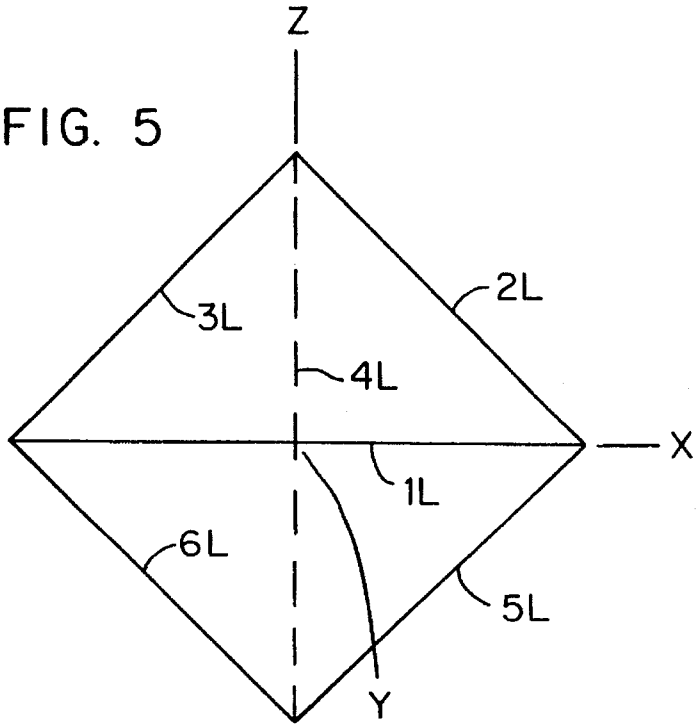
FIG. 5 is a frontal view of the rotated tetrahedron of FIG. 4 along the Y axis.

FIG. 5 is a frontal view along the Y axis of the rotated tetrahedron of FIG. 4. Leg 4L is shown as a dashed line since it is hidden from view.

FIG. 6 is again a view of a spherical tetrahedron; however, in this view, the tetrahedron has been rotated to the same angular relationship as the tetrahedron of solid geometry shown in FIG. 5 such that one of the legs (1L as shown) is coincident with a section or geodesic of the equator 1E. In this orientation, the midpoint of leg 4L, which is identified as point M2 in this drawing also lies on the equator 1E of the sphere, but on the backside of the sphere at a point exactly diametrically opposite the midpoint of leg 1L which is identified as point Mi. The intersection of legs 2L and 5L is identified as point B. If point B is connected to point M2 by a segment of a great circle, the arc B-M2 lies on the equator 1E and bisects the triangle formed by legs 5L, 2L, and 4L. If the intersection of legs 3L and 6L (identified as point A) is connected to point M2 by a segment of a great circle, the arc A-M2 lies on the equator 1E and bisects the triangle formed by the legs 3L, 4L, and 6L. If point A is connected to point B by a segment of a great circle, the resulting arc A-B is the leg 1L which lies on the equator 1E. With this information, it is readily seen that when arcs B-M2, A-M2 and A-B are connected, they form the entirety of the equator 1E. Thus the equator of the sphere represents the bisector of two of the triangles of the spherical tetrahedron and a shared leg of the other two triangles of the spherical tetrahedron.

Figure 6:
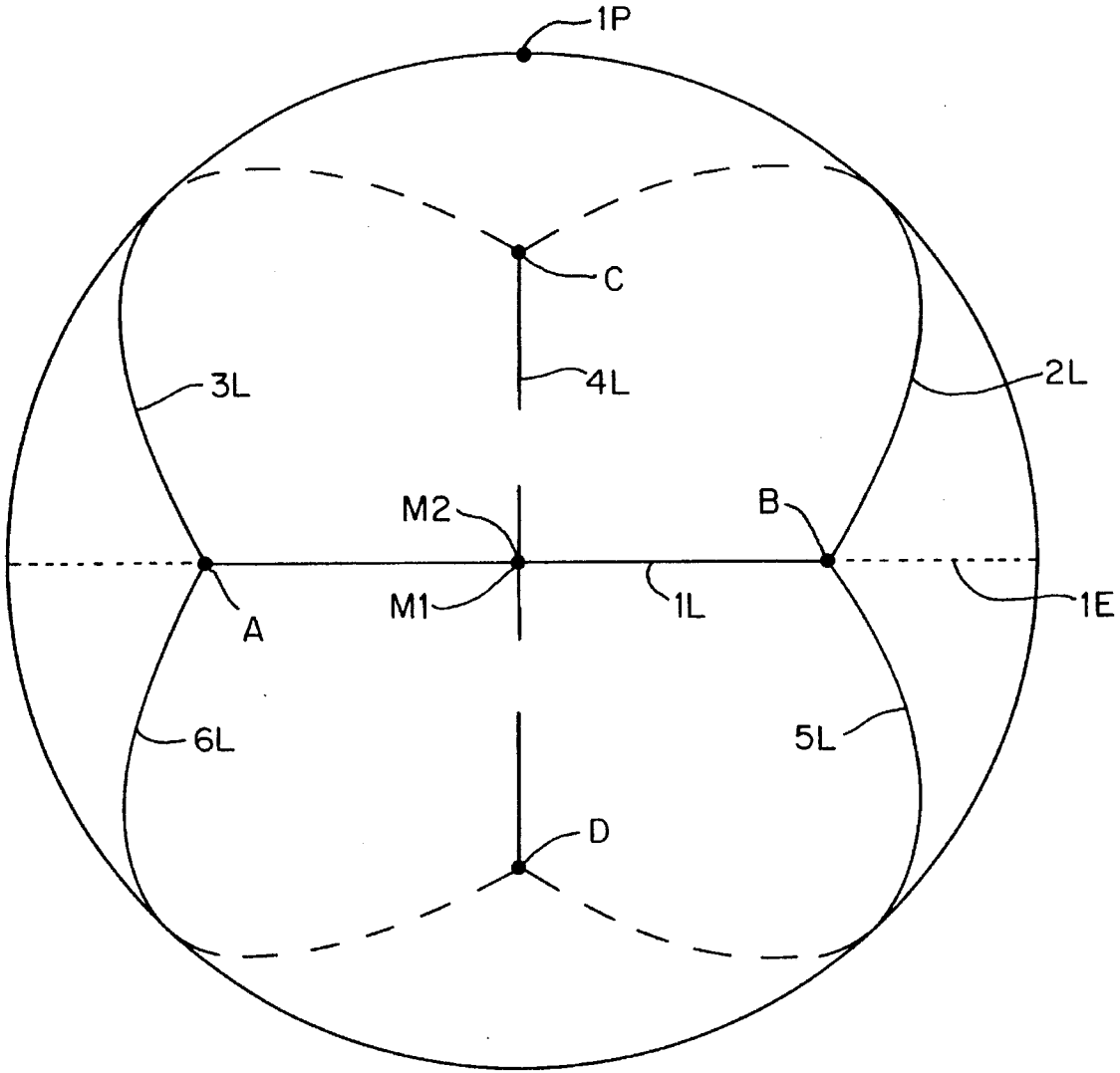
FIG. 6 is a drawing of a sphere having drawn thereon an outline of a spherical tetrahedron oriented in the same angular relationship as the tetrahedron shown in FIG. 5.
Figure 7:
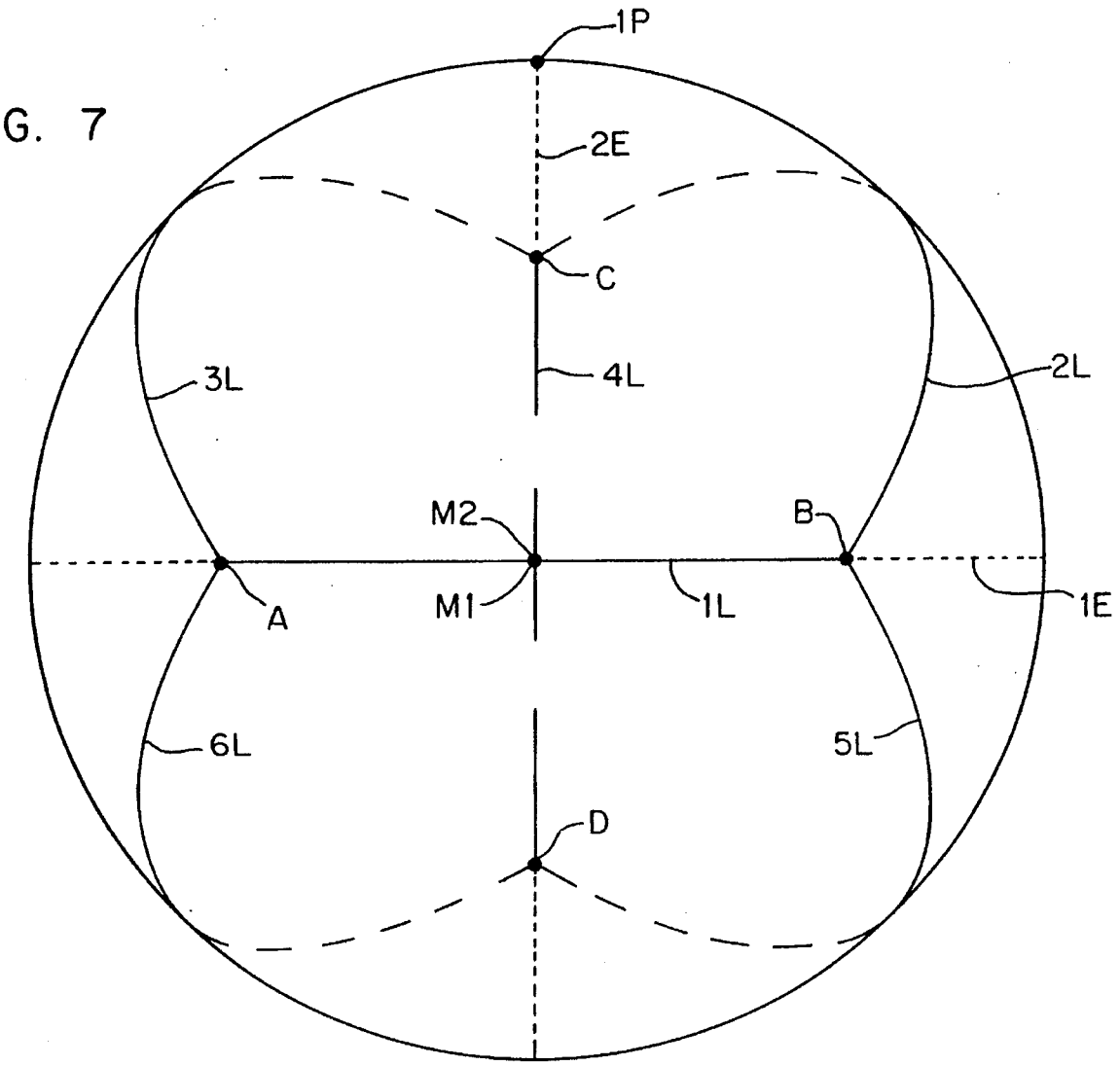
FIG. 7 is a drawing of a sphere having drawn thereon an outline of the spherical tetrahedron illustrated in FIG. 5 and an outline of a second great circle (2E).

FIG. 7 is a repeat of FIG. 6 except that a second great circle identified as 2E which is perpendicular to the equator 1E has been added to the drawing. Great circle 2E has the further constraint that leg 4L is coincident with a section of this great circle. From the teachings of FIG. 6, it is now known that this great circle 2E passes through the midpoint of leg 1L which is identified as point M1 on the drawing, bisects the triangle formed by legs 1L, 2L and 3L, and also bisects the triangle formed by the legs 1L, 5L, and 6L. As was pointed out in FIG. 6, the true equator 1E bisects two of the triangles of the tetrahedron and forms a shared leg (1L) of the other two remaining triangles. Great circle or false equator 2E bisects these remaining two triangles and forms a shared leg (4L) of the two triangles which were bisected by the equator 1E.

Thus by rotating a spherical tetrahedron so that one of the legs (shared by two of the triangles of the tetrahedron) is coincident with a section of the true equator, and by constructing a second great circle or equator which is perpendicular to and which bisects this leg, all four of the spherical triangles of the tetrahedron are bisected, and the eight identical spherical triangles which form the constraining pattern of this invention are created.

Since great circle or false equator 2E is perpendicular to the true equator 1E it passes through the pole 1P of the sphere. It should be noted that the pole 1P does not lie at the center of, or at the intersection of the apices of any of the constraining figures which have been created.

Figure 8:
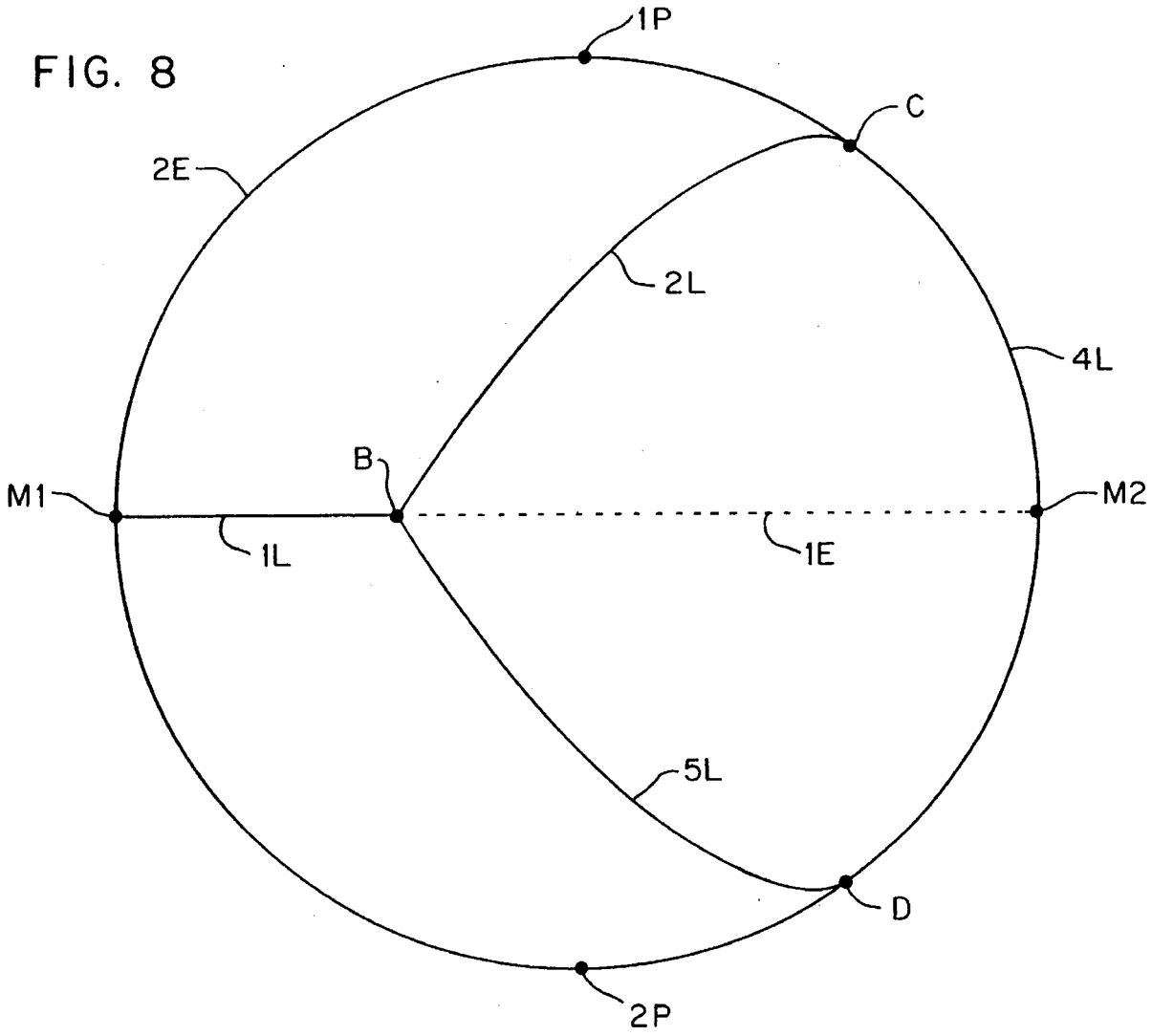
FIG. 8 is a drawing of the sphere of FIG. 7 arranged so the spherical tetrahedron is at a 90° right side view.

To further clarify the above, FIG. 8 is a right side view, and is 90 degrees from, the view of the spherical tetrahedron of FIG. 7. Here it can readily be seen that midpoints M1 and M2 lie diametrically opposite each other, that equator 1E does pass through midpoint M2 and thus bisect leg 4L, and that great circle 2E does pass through midpoint M1 and thus bisect leg 1L. Further, it is more readily obvious that the poles of the sphere 1P and 2P are neither at the centers of nor at the apexes of any of the constraining figures of the rotated and bisected spherical tetrahedron.

The current invention provided the golf ball with two parting lines which correspond to two great circular paths that encircle the ball where neither of the parting lines intersect any of the dimples. The dimples are arranged in eight spherical triangles the apexes of which meet to form a regular spherical tetrahedron which has been rotated and bisected. This pattern lends itself to good surface coverage of the sphere and allows the use of multiple dimple sizes in the developments of this coverage. Further, the rotation of the tetrahedron produces a pattern where the true pole of the ball is extremely difficult to find, since it does not lie in the center of or at the apex of one of the constraining figures.

The golf ball produced by the current invention has two parting lines which meet at right angles. One of these parting lines or great circles is the true equator of the ball. The second of these great circles passes through the pole of the golf ball. Since the USGA conducts the symmetry test so that rotation of the ball is first with the poles horizontal and secondly with the poles vertical or perpendicular to the first orientation, it can readily be seen that two parting lines or great circles is the minimum number of parting lines which will provide the aerodynamic symmetry which the test has been devised to ascertain. Further since the test is performed with perpendicular orientations it is obvious that the ideal orientation of the two great circles is perpendicular, i.e., at right angles to each other.

Figure 9:
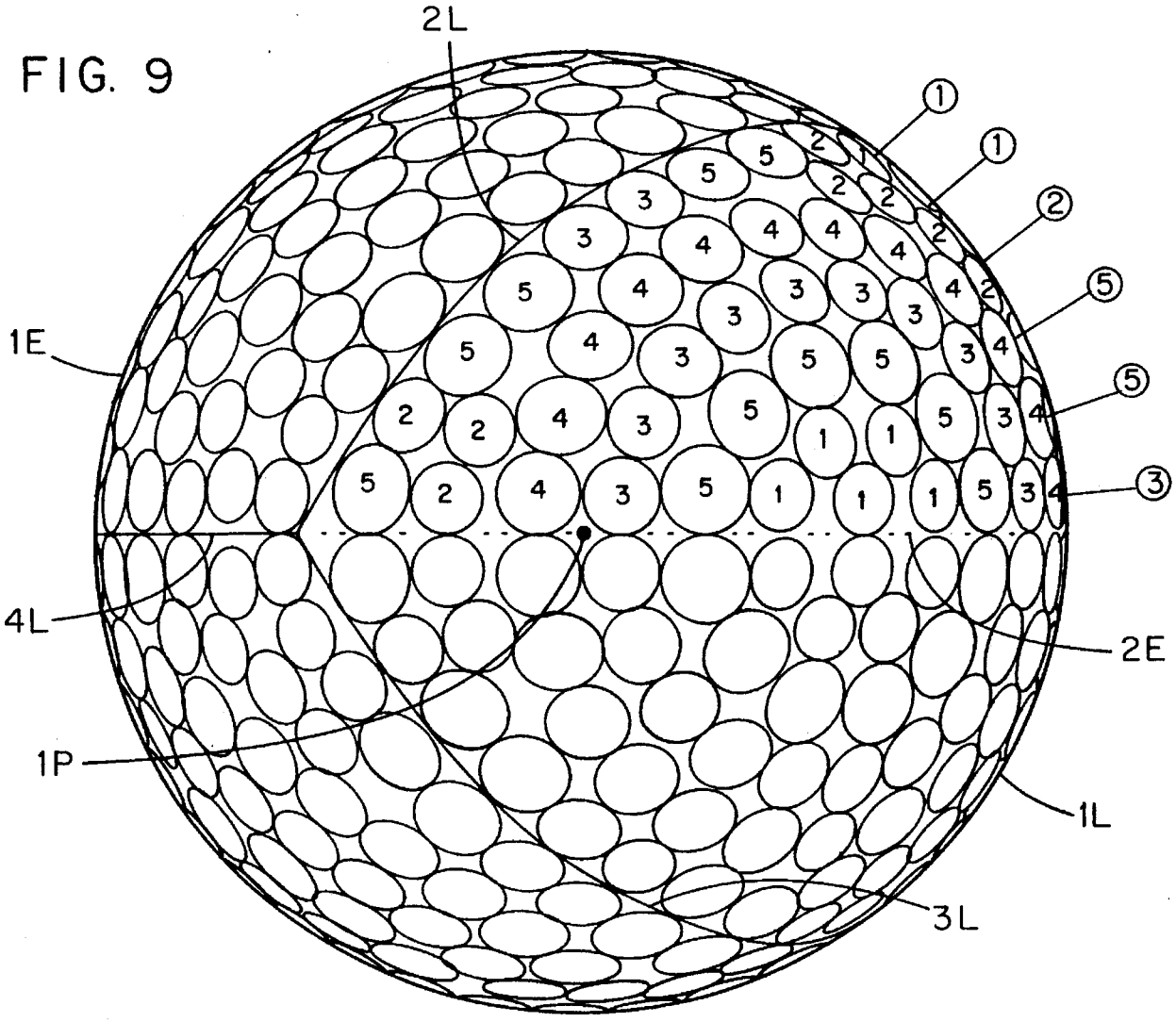
FIG. 9 is a polar view of the first embodiment of a golf ball according to the present invention.

FIG. 9 is a polar view of the first embodiment of a golf ball of the present invention. There are five different dimple sizes used in constructing the golf ball and these are identified by numbers 1 through 5. The size of dimple number 1 is maximum of about 0.127 inches, the size of dimple number 2 is maximum of about 0.132 inches, the size of dimple number 3 is maximum of about 0.137 inches, the size of dimple number 4 is a maximum of about 0.145 inches, and the size of dimple number 5 is a maximum of about 0.157 inches. Dimple sizes are identified in only one of the eight identical spherical triangles which form the constraining pattern of this invention. There is a total of 440 dimples on the golf ball of FIG. 9, none of which intersect the constraining lines of the eight identical spherical triangles. It is noteworthy that the polar view of the constraining pattern of FIG. 9 is identical to the equatorial view of FIG. 8 with the exception that different legs are now visible and the positions of equators 1E and 2E have been transposed. So an equatorial view of the golf ball of FIG. 9 would be identical to FIG. 9 and therefore redundant.

Figure 10:
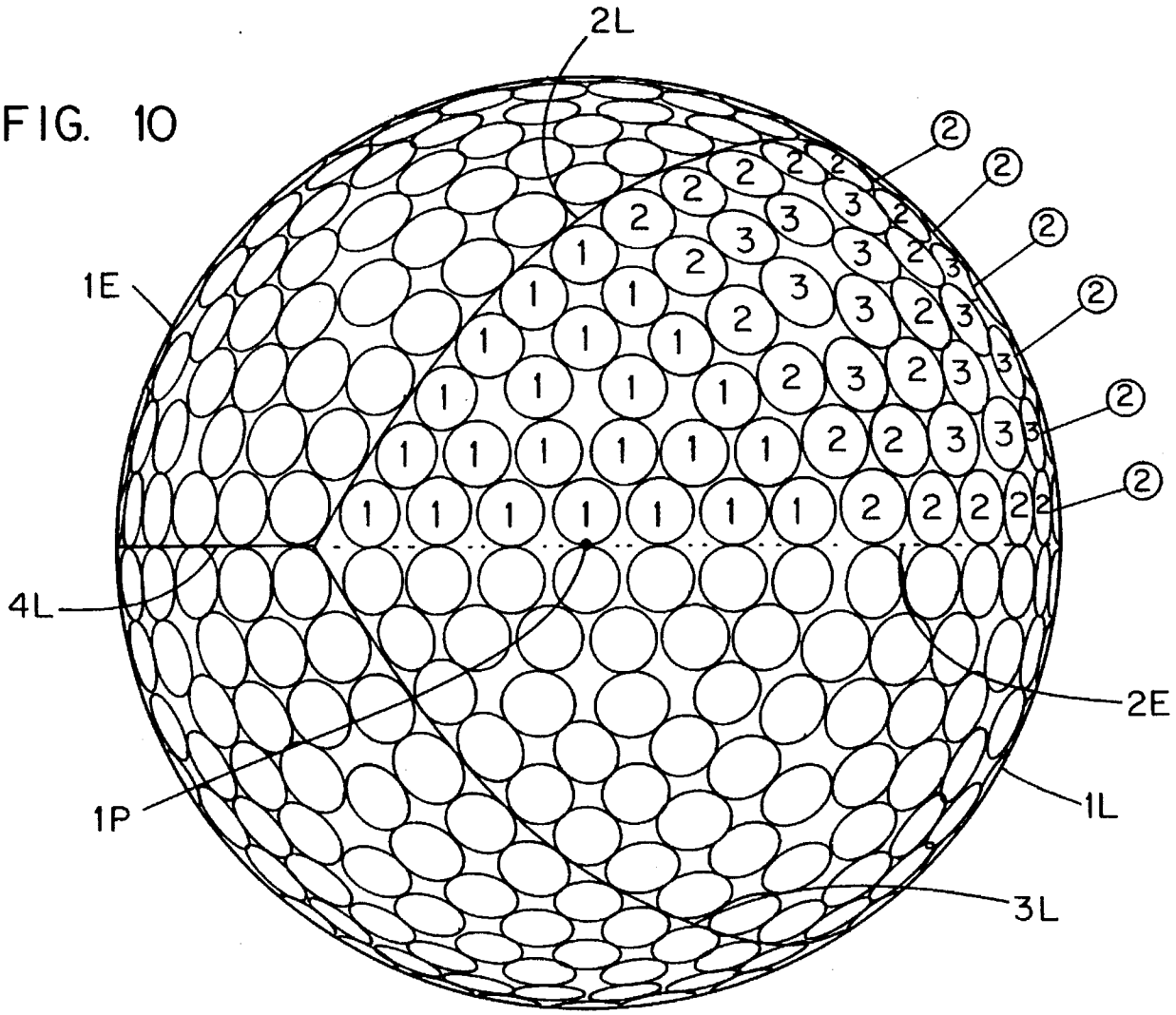
FIG. 10 is a polar view of the second embodiment of a golf ball according to the present invention.

FIG. 10 is a polar view of the second embodiment of a golf ball of the present invention which has 496 dimples of three different sizes. One of the eight identical spherical triangles of the present invention has the dimple sizes identified by the numbers 1, 2, and 3. The size of dimple number 1 is maximum of about 0.127 inches, the size of dimple number 2 is a maximum of about 0.137 inches, and the size of dimple number 3 is a maximum of about 0.142 inches.

The depressions or dimples may be of any size, shape, depth or number including multiple sizes, shapes and depths. The dimples should preferably cover at least about 50 percent of the surface of the sphere and more preferably at least about 70 percent of the surface of the sphere. Preferably each of the eight spherical triangles is identical in that each contains the same dimple pattern and number of dimples.

Figure 11:
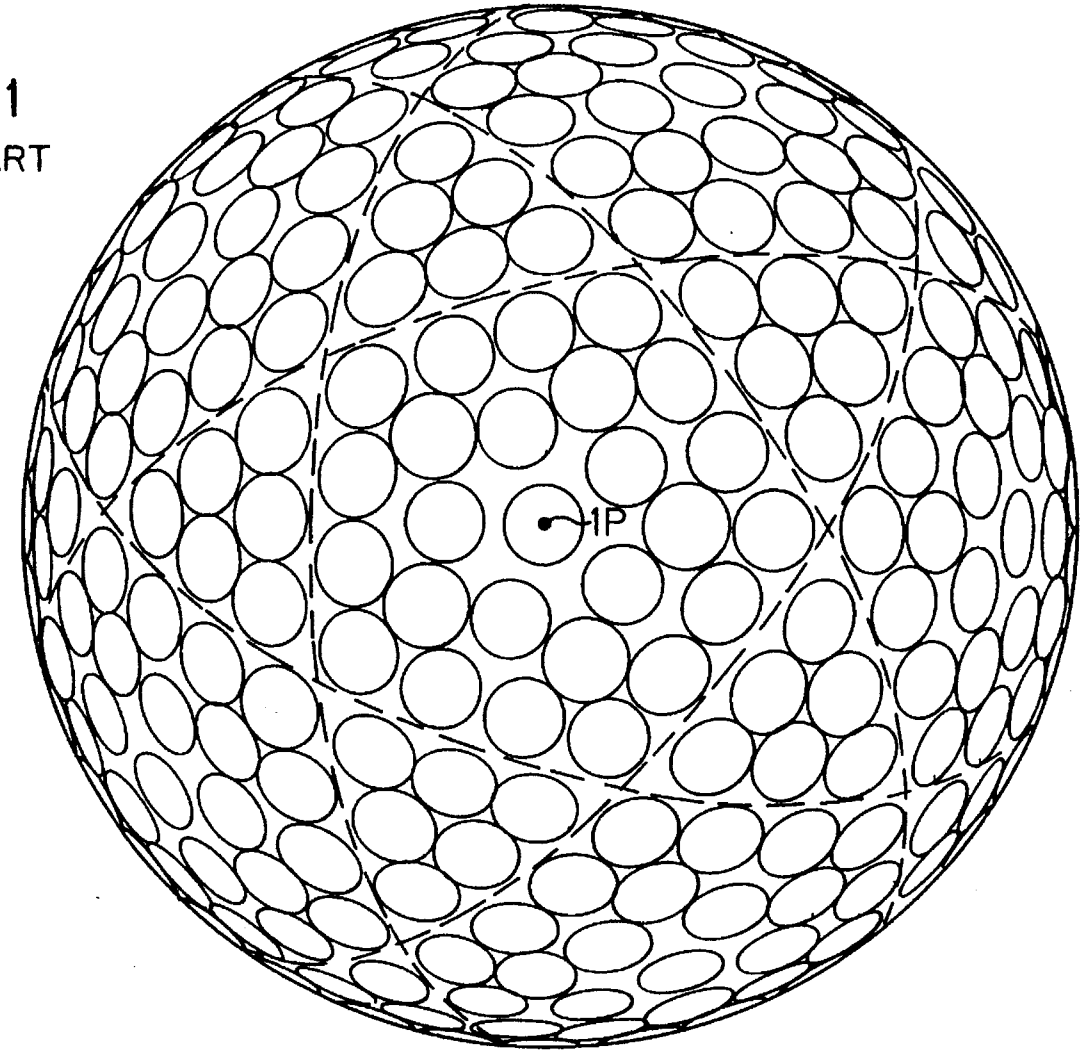
FIG. 11 PRIOR ART
FIG. 11 is a polar view of a prior art golf ball having 6 great circles.

FIG. 11 is a polar view of a popular prior art golf ball which has six great circles which form the constraining pattern for dimple layout. Five of these great circles are shown as dashed lines. The sixth great circle is the true equator and is the great circle which forms the periphery of the sphere in this view. This pole (identified as 1P) is in the exact center of one of the constraining figures.

Figure 12:
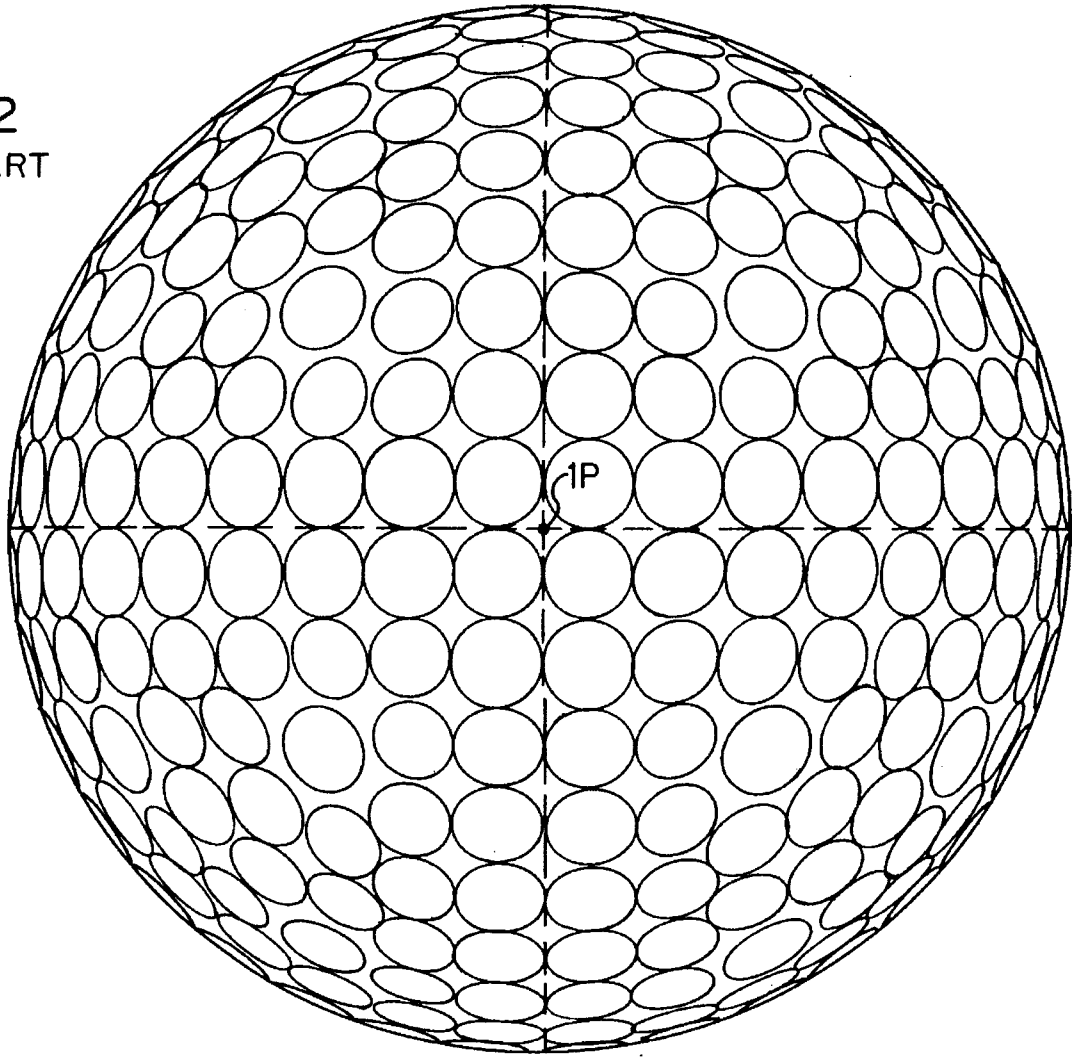
FIG. 12 PRIOR ART
FIG. 12 is a polar view of a prior art golf ball having 3 great circles.

FIG. 12 is a polar view of a golf ball of a pattern long known in the industry which has three great circles which form the constraining pattern for dimple layout. Two of these great circles are shown as dashed lines. The third great circle is the true equator and is the great circle which forms the periphery of the sphere in this view. The pole (identified as 1P) is at the intersection of the apexes of the constraining figures.

While only two embodiments of the golf ball according to the present invention are shown in the drawings, it should be understood and is considered a part of this invention that many golf balls could be constructed using the teachings and constraining figures of this invention.

What is claimed is:

1. A golf ball comprising a spherical surface having many dimples formed thereon and only first and second great circles which do not intersect any of said dimples, the dimples being arranged so the surface of the golf ball is divided into only four identical equilateral spherical triangles of a regular spherical tetrahedron, said triangles being so oriented so that: (a) the first great circle is coincident with one leg of the first and second triangles and bisects respectively the third and fourth triangles of the tetrahedron, (b) the second great circle is perpendicular to the first great circle and is coincident with one leg of the third and fourth triangles and bisects respectively the first and second triangles; the first, second, third and fourth triangles being bisected to form eight identical spherical triangles, said dimples being arranged in said eight identical triangles so that none of the dimples intersect the legs of the eight identical spherical triangles.

2. The golf ball of claim 1, wherein each of the eight identical spherical triangles has a substantially similar dimple pattern.

3. The golf ball of claim 2, wherein at least about 65% of the spherical surface is covered by dimples.

4. The golf ball of claim 2, wherein the dimples have at least two different dimple sizes.

5. The golf ball of claim 4, wherein the minimum dimple diameter is 0.11 inches and the maximum dimple diameter is 0.17 inches and at least 65% of the surface of the sphere is covered with dimples.

6. The golf ball of claim 1, wherein the ball includes poles on the second great circle, 90° from the first great circle, and that are at locations removed from the apex and the intersection of apices of said eight identical spherical triangles.

7. The golf ball of claim 1, wherein the ball includes poles on the second great circle, 90° from the first great circle, and are at locations removed from the center of each of said eight identical spherical triangles.

8. The golf ball of claim 1, wherein the total number of dimples is 440.

9. The golf ball of claim 8, wherein the dimples have five different sizes.

10. The golf ball of claim 9, wherein the diameters of the five dimple sizes are respectively approximately 0.127 inches, 0.132 inches, 0.137 inches, 0.145 inches, and 0.157 inches.

11. The golf ball of claim 8, wherein the dimples have three different sizes.

12. The golf ball of claim 11, wherein the diameters of the five dimple sizes are respectively approximately 0.127 inches, 0.137 inches, and 0.142 inches.

13. The golf ball of claim 1, wherein the total number of dimples is 496.

14. A golf ball having a spherical surface including many approximately uniformly distributed dimples, the dimples being arranged so there are only two great circles of the surface that do not have dimples lying thereon, said two great circles being first and second mutually perpendicular great circles, the dimples being arranged so the surface is divided into first, second, third and fourth substantially identical equilateral spherical triangles, said triangles being arranged so: (a) the first great circle is formed by one common leg of the first and second triangles and a bisector of the third and fourth triangles, and (b) the second great circle is formed by one common leg of the third and fourth triangles and a bisector of the first and second triangles; the first, second, third and fourth triangles being bisected to form eight substantially identical spherical triangles, said dimples being arranged in said eight identical triangles so that none of the dimples intersect the legs of the eight identical spherical triangles.

15. The golf ball of claim 14, wherein each of the eight identical spherical triangles has a substantially similar dimple pattern.

16. The golf ball of claim 14, wherein the ball includes poles on the second great circle, 90° from the first great circle, and that are at locations removed from the apex and the intersection of apices of said eight identical spherical triangles.

17. The golf ball of claim 14, wherein the ball includes poles on the second great circle, 90° from the first great circle, and are at locations removed from the center of each of said eight identical spherical triangles.

18. A golf ball having a spherical surface including many approximately uniformly distributed dimples, the dimples being arranged so there are only two great circles of the surface that do not have dimples lying thereon, said two great circles being first and second mutually perpendicular great circles, the dimples being arranged so the surface is divided into first, second, third and fourth identical equilateral spherical triangles, said triangles being arranged so: (a) the first great circle is formed by one common leg of the first and second triangles and a bisector of the third and fourth triangles, and (b) the second great circle is formed by one common leg of the third and fourth triangles and a bisector of the first and second triangles, the dimples being arranged in said triangles so none of the dimples intersect the legs of the triangles.

19. The golf ball of claim 18 wherein the first, second, third and fourth triangles are bisected to form eight identical spherical triangles, said dimples being arranged in said eight identical triangles so that none of the dimples intersect the legs of the eight identical spherical triangles.

20. A golf ball having a spherical surface including many approximately uniformly distributed dimples, the dimples being arranged so there are only two great circles of the surface that do not have dimples lying thereon.

21. The golf ball of claim 20 wherein said two great circles are first and second mutually perpendicular great circles.

* * * * *